US008642143B2

(12) United States Patent
Simpson et al.

(10) Patent No.: US 8,642,143 B2
(45) **Date of Patent: *Feb. 4, 2014**

(54) TRANSPARENT INK-JET RECORDING FILMS, COMPOSITIONS, AND METHODS

(75) Inventors: Sharon M. Simpson, Lake Elmo, MN (US); Heidy M. Vosberg, Lake Elmo, MN (US); Daniel P. Leach, Rochester, NY (US); William J. Ruzinsky, Loveland, CO (US); William D. Devine, Fort Collins, CO (US)

(73) Assignee: Carestream Health, Inc., Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/565,888

(22) Filed: Aug. 3, 2012

(65) Prior Publication Data

US 2013/0040077 A1 Feb. 14, 2013

Related U.S. Application Data

(60) Provisional application No. 61/522,726, filed on Aug. 12, 2011.

(51) Int. Cl.

| | |
|---|---|
| ***B41M 5/00*** | (2006.01) |
| ***B41M 5/52*** | (2006.01) |
| ***B41M 5/50*** | (2006.01) |

(52) U.S. Cl.

CPC ..... *B41M 5/52* (2013.01); *B41M 5/5254* (2013.01); *B41M 5/506* (2013.01); *B41M 5/504* (2013.01); *B41M 5/5218* (2013.01)

USPC ..... 428/32.13; 428/32.22; 428/32.25; 428/32.26; 428/32.27; 428/32.28; 428/32.31; 428/32.35

(58) Field of Classification Search

CPC ..... B41M 5/52; B41M 5/5254; B41M 5/506; B41M 5/504; B41M 5/5218

USPC ..... 428/32.13, 32.22, 32.25, 32.26, 32.27, 428/32.28, 32.31, 32.35

See application file for complete search history.

(56) References Cited

U.S. PATENT DOCUMENTS

| | | | | |
|---|---|---|---|---|
| 3,143,421 | A | 8/1964 | Nadeau et al. | |
| 4,365,423 | A | 12/1982 | Arter et al. | |
| 4,833,060 | A | 5/1989 | Nair et al. | |
| 5,354,799 | A | 10/1994 | Bennett et al. | |
| 5,795,708 | A | 8/1998 | Boutet | |
| 6,457,824 | B1 | 10/2002 | Wexler | |
| 6,555,301 | B2 | 4/2003 | Smith et al. | |
| 6,630,283 | B1 | 10/2003 | Simpson et al. | |
| 2003/0081103 | A1 * | 5/2003 | Ishimaru et al. | 347/105 |
| 2003/0103122 | A1 * | 6/2003 | Missell et al. | 347/101 |
| 2007/0292638 | A1 * | 12/2007 | Kim | 428/32.2 |
| 2012/0009364 | A1 | 1/2012 | Simpson et al. | |
| 2012/0045595 | A1 | 2/2012 | Simpson et al. | |
| 2012/0100315 | A1 | 4/2012 | Simpson et al. | |

FOREIGN PATENT DOCUMENTS

| | | | |
|---|---|---|---|
| EP | 1 538 005 | A1 | 6/2005 |
| EP | 2 181 854 | A1 | 5/2010 |
| JP | 2002-172854 | | 6/2002 |
| WO | WO 2008/075041 | A1 | 6/2008 |
| WO | WO 2012/054371 | A1 | 4/2012 |

OTHER PUBLICATIONS

International Search Report mailed Nov. 22, 2012 for International Application No. PCT/US2012/049683, 3 pages.

Research Disclosure 308119, Dec. 1989, 46 pages.

* cited by examiner

*Primary Examiner* — Betelhem Shewareged

(74) *Attorney, Agent, or Firm* — Reed L. Christiansen

(57) ABSTRACT

Transparent ink-jet recording films, compositions, and methods are disclosed. Such films exhibit superior resistance to ink-transfer when printed to high optical densities, which is desirable for medical imaging applications.

18 Claims, No Drawings

TRANSPARENT INK-JET RECORDING FILMS, COMPOSITIONS, AND METHODS

CROSS REFERENCE TO RELATED APPLICATIONS

This application claims the benefit of U.S. Provisional Application No. 61/522,726, TRANSPARENT INK JET RECORDING FILMS, COMPOSITIONS, AND METHODS, filed Aug. 12, 2011, which is hereby incorporated by reference in its entirety.

SUMMARY

Transparent ink-jet recording films often employ one or more image-receiving layers on one or both sides of a transparent support. In order to obtain high image densities when printing on transparent films, more ink is often applied than is required for opaque films. To be able to accommodate more printing ink, image-receiving layer thicknesses can be increased relative to those in opaque films. The compositions and methods of the present application can provide transparent ink-jet recording films with increased image-receiving layer thicknesses. Such films can exhibit high maximum optical densities, rapid ink drying, low curl, and excellent back-coat adhesion.

At least one embodiment provides a transparent ink-jet recording film comprising a transparent substrate comprising a polyester, where the substrate comprises at least a first surface and a second surface; at least one under-layer disposed on the first surface, where the at least on under-layer comprises gelatin and at least one borate or borate derivative; at least one image-receiving layer comprising at least one water soluble or water dispersible polymer comprising at least one hydroxyl group; and at least one back-coat layer disposed on the second surface, where the at least one back-coat layer comprises gelatin and at least one polymer particle comprising at least one thermoplastic polymer, where the at least one polymer particle comprises a dry coverage of at least about 40 mg/m$^2$.

In at least some embodiments, the at least one polymer particle may, for example, comprise at least one polymer comprising at least one acrylic or methacrylic repeat unit. An exemplary polymer is poly(methyl methacrylate).

In some cases, the at least one polymer particle may comprise a dry coverage of at least about 40 mg/m$^2$, or at least about 80 mg/m$^2$, or at least about 100 mg/m$^2$, such as, for example, a dry coverage of at least about 80 mg/m$^2$ and less than about 200 mg/m$^2$, or at least about 100 mg/m$^2$ and less than about 200 mg/m$^2$. Or the at least one polymer particle may, for example, comprise a dry coverage of at least about 40 mg/m$^2$ and less than about 1000 mg/m$^2$.

In at least some embodiments, the at least one polymer particle may comprise a mean diameter of at least about 5 μm and less than about 25 μm, or at least about 10 μm and less than about 20 μm. In some cases, the mean diameter may be about 10 μm or the mean diameter may be about 15 μm.

In at least some embodiments, the at least one back-coat layer may further comprise at least one other hydrophilic colloid comprising at least one of sodium carboxymethylate casein or a polyacrylamide. In some case, the at least some cases, the at least one back-coat layer may comprise both sodium carboxymethylate casein and a polyacrylamide.

In at least some embodiments, the at least one back-coat layer may further comprise at least one polysiloxane.

In at least some embodiments, the at least one back-coat layer may comprise at least one first layer and at least one second layer, where the at least one first layer is disposed between the at least one second layer and the second surface of the substrate. The at least one first layer may, for example, comprise gelatin and at least one hardener. The at least one second layer may, for example, comprise gelatin and the at least one polymer particle. In some cases, the at least one second layer further comprises at least one other hydrophilic colloid comprising at least one of sodium carboyxmethylate casein or a polyacrylamide, or, for example, the at least one second layer may comprise both sodium carboxymethylate casein and a polyacrylamide. In at least some cases, the at least one second layer further comprises at least one polysiloxane. The hardener may, for example, comprise bis(vinylsulfonyl)methane.

In at least some embodiments, the at least one inorganic particle may, for example, comprise boehmite alumina.

In at least some embodiments, the at least one borate or borate derivative may comprise at least one hydrate of sodium tetraborate, such as, for example, sodium tetraborate decahydrate.

In at least some embodiments, the at least one water soluble or water dispersible polymer may, for example, comprise poly(vinyl alcohol).

Such transparent ink-jet recording films may, in some cases, exhibit an ink transfer measurement of less than about two squares transferred, based on 390 ⅛-in×⅛-in squares, when subjected to a compression of 0.081 psi pressure and 85% relative humidity for seven days. Or such films may, for example, exhibit an ink transfer measurement of less than about 31 squares transferred, based on 390 ⅛-in×⅛-in squares, when subjected to a compression of 5.7 psi pressure and 86% relative humidity for seven days. Or such films may, for example, exhibit an ink transfer measurement of less than about 9 squares transferred, based on 390 ⅛-in×⅛-in squares, when subjected to a compression of 5.7 psi pressure and 86% relative humidity for seven days.

These embodiments and other variations and modifications may be better understood from the description, exemplary embodiments, examples, and claims that follow. Any embodiments provided are given only by way of illustrative example. Other desirable objectives and advantages inherently achieved may occur or become apparent to those skilled in the art.

DESCRIPTION

All publications, patents, and patent documents referred to in this document are incorporated by reference herein in their entirety, as though individually incorporated by reference.

U.S. Provisional Application No. 61/522,726, TRANSPARENT INK JET RECORDING FILMS, COMPOSITIONS, AND METHODS, filed Aug. 12, 2011, is hereby incorporated by reference in its entirety.

The term "polymer," unless otherwise qualified, includes homopolymers, copolymers, terpolymers, and the like, including statistically random copolymers, block copolymers, and the like, irrespective of tacticity.

Introduction

An ink-jet recording film may comprise at least one image-receiving layer, which receives ink from an ink-jet printer during printing, and a substrate or support, which may be opaque or transparent. An opaque support may be used in films that may be viewed using light reflected by a reflective backing, while a transparent support may be used in films that may be viewed using light transmitted through the film.

Some medical imaging applications require high image densities. For a reflective film, high image densities may be achieved by virtue of the light being absorbed on both its path into the imaged film and again on the light's path back out of the imaged film from the reflective backing. On the other hand, for a transparent film, because of the lack of a reflective backing, achievement of high image densities may require application of larger quantities of ink than are common for opaque films.

Application of such quantities of ink during printing increases the amount of carrier fluids that must be removed after printing. Because of the high throughput of many ink-jet printers, the removal of such carrier fluids may be incomplete, possibly resulting in wet media and adhesion between the image-carrier layer of one media sheet and the back-coat layer of the sheet just above it. In some cases, ink may be transferred between the two sheets, affecting the quality of the printed image.

Transparent ink-jet films, compositions, and methods are presented that provide superior ink drying and ink transfer performance when printed to optical densities of, for example, at least about 2.8.

Transparent Ink-Jet Films

Transparent ink-jet recording films are known in the art. See, for example, U.S. patent application Ser. No. 13/117,214, "TRANSPARENT INK-JET RECORDING FILM," by Simpson et al., filed May 27, 2011, and U.S. patent application Ser. No. 13/208,379, "TRANSPARENT INK-JET RECORDING FILMS, COMPOSITIONS, AND METHODS," by Simpson et al., filed Aug. 12, 2011, both of which are herein incorporated by reference in their entirety.

Transparent ink-jet recording films may comprise one or more transparent substrates upon which at least one under-layer may be coated. Such an under-layer may optionally be dried before being further processed. The film may further comprise one or more image-receiving layers coated upon at least one under-layer. Such an image-receiving layer is generally dried after coating. In some embodiments, the film may further comprise additional layers, such as one or more back-coat layers or overcoat layers, as will be understood by those skilled in the art.

Transparent Substrate

Transparent substrates may be flexible, transparent films made from polymeric materials, such as, for example, polyethylene terephthalate, polyethylene naphthalate, cellulose acetate, other cellulose esters, polyvinyl acetal, polyolefins, polycarbonates, polystyrenes, and the like. In some embodiments, polymeric materials exhibiting good dimensional stability may be used, such as, for example, polyethylene terephthalate, polyethylene naphthalate, other polyesters, or polycarbonates.

Other examples of transparent substrates are transparent, multilayer polymeric supports, such as those described in U.S. Pat. No. 6,630,283 to Simpson, et al., which is hereby incorporated by reference in its entirety. Still other examples of transparent supports are those comprising dichroic mirror layers, such as those described in U.S. Pat. No. 5,795,708 to Boutet, which is hereby incorporated by reference in its entirety.

Transparent substrates may optionally contain colorants, pigments, dyes, and the like, to provide various background colors and tones for the image. For example, a blue tinting dye is commonly used in some medical imaging applications. These and other components may optionally be included in the transparent substrate, as will be understood by those skilled in the art.

In some embodiments, the transparent substrate may be provided as a continuous or semi-continuous web, which travels past the various coating, drying, and cutting stations in a continuous or semi-continuous process.

Under-Layer Coating Mix

Under-layers may be formed by applying at least one under-layer coating mix to one or more transparent substrates. The under-layer coating mix may comprise gelatin. In at least some embodiments, the gelatin may be a Regular Type IV bovine gelatin. The under-layer coating mix may further comprise at least one borate or borate derivative, such as, for example, sodium borate, sodium tetraborate, sodium tetraborate decahydrate, boric acid, phenyl boronic acid, butyl boronic acid, and the like. More than one type of borate or borate derivative may optionally be included in the under-layer coating mix. In some embodiments, the borate or borate derivative may be used in an amount of up to, for example, about 2 $g/m^2$. In at least some embodiments, the ratio of the at least one borate or borate derivative to the gelatin may be between about 20:80 and about 1:1 by weight, or the ratio may be about 0.45:1 by weight. In some embodiments, the under-layer coating mix may comprise, for example, at least about 4 wt % solids, or at least about 9.2 wt % solids. The under-layer coating mix may comprise, for example, about 15 wt % solids.

The under-layer coating mix may also comprise a thickener. Examples of suitable thickeners include, for example, anionic polymers, such as sodium polystyrene sulfonate, other salts of polystyrene sulfonate, salts of copolymers comprising styrene sulfonate repeat units, anionically modified polyvinyl alcohols, and the like.

In some embodiments, the under-layer coating mix may optionally further comprise other components, such as surfactants, such as, for example, nonyl phenol, glycidyl polyether. In some embodiments, such a surfactant may be used in amount from about 0.001 to about 0.20 $g/m^2$, as measured in the under-layer. These and other optional mix components will be understood by those skilled in the art.

Image-Receiving Layer Coating Mix

Image-receiving layers may be formed by applying at least one image-receiving layer coating mix to one or more under-layer coatings. The image-receiving coating mix may comprise at least one water soluble or dispersible cross-linkable polymer comprising at least one hydroxyl group, such as, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers, such as, for example, hydroxyethylcellulose, and the like. More than one type of water soluble or water dispersible cross-linkable polymer may optionally be included in the under-layer coating mix. In some embodiments, the at least one water soluble or water dispersible polymer may be used in an amount of up to about 1.0 to about 4.5 $g/m^2$, as measured in the image-receiving layer.

The image-receiving layer coating mix may also comprise at least one inorganic particle, such as, for example, metal oxides, hydrated metal oxides, boehmite alumina, clay, calcined clay, calcium carbonate, aluminosilicates, zeolites, barium sulfate, and the like. Non-limiting examples of inorganic particles include silica, alumina, zirconia, and titania. Other non-limiting examples of inorganic particles include fumed silica, fumed alumina, and colloidal silica. In some embodiments, fumed silica or fumed alumina have primary particle sizes up to about 50 nm in diameter, with aggregates being less than about 300 nm in diameter, for example, aggregates of about 160 nm in diameter. In some embodiments, colloidal silica or boehmite alumina have particle size less than about 15 nm in diameter, such as, for example, 14 nm in diameter. More than one type of inorganic particle may optionally be included in the image-receiving coating mix.

In at least some embodiments, the ratio of inorganic particles to polymer in the at least one image-receiving layer coating mix may be, for example, between about 88:12 and about 95:5 by weight, or the ratio may be about 92:8 by weight.

Image-receiving layer coating layer mixes prepared from alumina mixes with higher solids fractions can perform well in this application. However, high solids alumina mixes can, in general, become too viscous to be processed. It has been discovered that suitable alumina mixes can be prepared at, for example, 25 wt % or 30 wt % solids, where such mixes comprise alumina, nitric acid, and water, and where such mixes comprise a pH below about 3.09, or below about 2.73, or between about 2.17 and about 2.73, as measured prior to an optional heating step. During preparation, such alumina mixes may optionally be heated, for example, to 80° C.

The image-receiving coating layer mix may also comprise one or more surfactants such as, for example, nonyl phenol, glycidyl polyether. In some embodiments, such a surfactant may be used in amount of, for example, about 1.5 g/m$^2$, as measured in the image-receiving layer. In some embodiments, the image-receiving coating layer may also optionally comprise one or more acids, such as, for example, nitric acid.

These and components may optionally be included in the image-receiving coating layer mix, as will be understood by those skilled in the art.

Back-coat Layer Coating Mix

Back-coat layers may be formed by applying at least one back-coat coating mix to one or more transparent substrates. In some embodiments, the at least one back-coat layer coating mix may be applied on the side of the one or more transparent substrates opposite to that which the under-layer coating mix or image receiving layer coating mix is applied.

The at least one back-coat layer coating mix may comprise gelatin. In at least some embodiments, the gelatin may be a Regular Type IV bovine gelatin.

The at least one back-coat layer coating mix may further comprise other hydrophilic colloids, such as, for example, dextran, gum arabic, zein, casein, pectin, collagen derivatives, collodion, agar-agar, arrowroot, albumin, and the like. Other examples of hydrophilic colloids are water-soluble polyvinyl compounds such as polyvinyl alcohol, polyacrylamides, polymethacrylamide, poly(N,N-dimethacrylamide), poly(N-isopropylacrylamide), poly(vinylpyrrolidone), poly (vinyl acetate), polyalkylene oxides such as polyethylene oxide, poly(6,2-ethyloxazolines), polystyrene sulfonate, polysaccharides, or cellulose derivatives such as carboxymethyl cellulose, hydroxyethyl cellulose, their sodium salts, and the like.

In at least some embodiments, the at least one back-coat layer may further comprise at least one other hydrophilic colloid comprising at least one of sodium carboxymethylate casein or a polyacrylamide. In some case, the at least some cases, the at least one back-coat layer may comprise both sodium carboxymethylate casein and a polyacrylamide.

In some cases, the at least one back-coat layer may further comprise at least one polysiloxane. Such compounds are sometimes referred to as silicones, because of the presence of silicon-oxygen bonds in their backbone chain.

The at least one back-cat layer coating mix may further comprise at least one polymer particle comprising at least one thermoplastic polymer. Such polymer particles may have a mean diameter of, for example, from about 5 μm to about 25 μm. For example, such polymer particles may have a mean diameter of about 10 μm or about 15 μm.

Examples of suitable thermoplastic polymers include, for example, polyesters, acrylic polymers, styrenic polymers, and the like. Such thermoplastic polymers may have softening points, as measured by ASTM E28 ring and ball method, of at least about 50° C., or from about 50° C. to about 120° C. In some embodiments, such thermoplastic polymers may comprise at least one polymer comprising at least one acrylic or methacrylic repeat unit, such as, for example, poly(methyl methacrylate). Other exemplary polymers are those comprising repeat units based on acrylic acid esters, such as ethyl acrylate or butyl acrylate, methacrylic acid esters, such as methyl methacrylate or ethyl methacrylate.

In some cases, the at least one polymer particle may comprise a dry coverage of at least about 40 mg/m$^2$, or at least about 80 mg/m$^2$, or at least about 100 mg/m$^2$ such as, for example, a dry coverage of at least about 40 mg/m$^2$ and less than about 1000 mg/m$^2$, or a dry coverage of at least about 80 mg/m$^2$ and less than about 200 mg/m$^2$, or at least about 100 mg/m$^2$ and less than about 200 mg/m$^2$.

The at least one back-coat layer coating mix may further comprise at least one hardening agent. In some embodiments, the at least one hardening agent may be added to the coating mix as the coating mix is being applied to the substrate, for example, by adding the at least one hardening agent upstream of an in-line mixer located in a line downstream of the back-coat coating mix tank. In some embodiments, such hardeners may include, for example, 1,2-bis(vinylsulfonylacetamido)ethane, bis (vinylsulfonyl)methane, bis(vinylsulfonylmethyl)ether, bis(vinylsulfonylethyl)ether, 1,3-bis(vinylsulfonyl)propane, 1,3-bis(vinylsulfonyl)-2-hydroxypropane, 1,1,-bis(vinylsulfonyl)ethylbenzenesulfonate sodium salt, 1,1,1-tris(vinylsulfonyl)ethane, tetrakis(vinylsulfonyl)methane, tris(acrylamido)hexahydro-s-triazine, copoly(acrolein-methacrylic acid), glycidyl ethers, acrylamides, dialdehydes, blocked dialdehydes, alpha-diketones, active esters, sulfonate esters, active halogen compounds, s-triazines, diazines, epoxides, formaldehydes, formaldehyde condensation products anhydrides, aziridines, active olefins, blocked active olefins, mixed function hardeners such as halogen-substituted aldehyde acids, vinyl sulfones containing other hardening functional groups, 2,3-dihydroxy-1,4-dioxane, potassium chrome alum, polymeric hardeners such as polymeric aldehydes, polymeric vinylsulfones, polymeric blocked vinyl sulfones and polymeric active halogens. In some embodiments, the at least one hardening agent may comprise a vinylsulfonyl compound, such as, for example bis(vinylsulfonyl)methane, 1,2-bis(vinylsulfonyl)ethane, 1,1-bis(vinylsulfonyl)ethane, 2,2-bis(vinylsulfonyl)propane, 1,1-bis(vinylsulfonyl)propane, 1,3-bis(vinylsulfonyl)propane, 1,4-bis(vinylsulfonyl) butane, 1,5-bis(vinylsulfonyl)pentane, 1,6-bis(vinylsulfonyl) hexane, and the like.

In at least some embodiments, the at least one back-coat layer may comprise at least one first layer and at least one second layer, where the at least one first layer is disposed between the at least one second layer and the second surface of the substrate. The at least one first layer may, for example, comprise gelatin and at least one hardener. The at least one second layer may, for example, comprise gelatin and the at least one polymer particle. In some cases, the at least one second layer further comprises at least one other hydrophilic colloid comprising at least one of sodium carboyxmethylate casein or a polyacrylamide, or, for example, the at least one second layer may comprise both sodium carboxymethylate casein and a polyacrylamide. In at least some cases, the at least one second layer further comprises at least one polysiloxane.

In some embodiments, the at least one back-coat layer coating mix may optionally further comprise at least one surfactant, such as, for example, one or more anionic surfactants, one or more cationic surfactants, one or more fluorosurfactants, one or more nonionic surfactants, and the like. These and other optional mix components will be understood by those skilled in the art.

Coating

The at least one under-layer and at least one image-receiving layer may be coated from mixes onto the transparent substrate. The various mixes may use the same or different solvents, such as, for example, water or organic solvents. Layers may be coated one at a time, or two or more layers may be coated simultaneously. For example, simultaneously with application of an under-layer coating mix to the support, an image-receiving layer may be applied to the wet under-layer using such methods as, for example, slide coating.

The at least one back-coat layer may be coated from at least one mix onto the opposite side of the transparent substrate from the side on which the at least one under-layer coating mix and the at least one image-receiving layer coating mix are coated. In at least some embodiments, two or more mixes may be combined and mixed using an in-line mixer to form the coating that is applied to the substrate. The at least one back-coat layer may be applied simultaneously with the application of either of the at least one under-layer or at least one image receiving layer, or may be coated independently of the application of the other layers.

Layers may be coated using any suitable methods, including, for example, dip-coating, wound-wire rod coating, doctor blade coating, air knife coating, gravure roll coating, reverse-roll coating, slide coating, bead coating, extrusion coating, curtain coating, and the like. Examples of some coating methods are described in, for example, *Research Disclosure*, No. 308119, Dec. 1989, pp. 1007-08, (available from Research Disclosure, 145 Main St., Ossining, N.Y., 10562, http://www.researchdisclosure.com).

Drying

Coated layers, such as, for example under-layers or image-receiving layers, may be dried using a variety of known methods. Examples of some drying methods are described in, for example, *Research Disclosure*, No. 308119, Dec. 1989, pp. 1007-08, (available from Research Disclosure, 145 Main St., Ossining, N.Y., 10562, http://www.researchdisclosure.com). In some embodiments, coating layers may be dried as they travel past one or more perforated plates through which a gas, such as, for example, air or nitrogen, passes. Such an impingement air dryer is described in U.S. Pat. No. 4,365,423 to Arter et al., which is incorporated by reference in its entirety. The perforated plates in such a dryer may comprise perforations, such as, for example, holes, slots, nozzles, and the like. The flow rate of gas through the perforated plates may be indicated by the differential gas pressure across the plates. The ability of the gas to remove water may be limited by its dew point, while its ability to remove organic solvents may be limited by the amount of such solvents in the gas, as will be understood by those skilled in the art.

Other Layers

In some embodiments, the transparent ink-jet recording film may comprise other layers, such as, for example, primer layers or subbing layers disposed between the at least one under-layer and the transparent substrate, or disposed between the at least one back-coat layer and the transparent substrate, or both. In at least some embodiments, at least one subbing layer may be disposed on at least one primer layer. Such layers may, for example, be coated and dried using processes similar to those described for applying under-layers and image-receiving layers.

In embodiments comprising at least one primer layer, such primer layers may, for example, be adjacent to one or more of the substrate surfaces, with the other layers disposed on the primer layers. Primer layers may be used in combination with or in lieu of treatment of the substrate surface. In some embodiments, a primer layer may comprise a coating thickness of about 0.112 g/m$^2$ on a dry basis.

Such primer layers may comprise adhesion promoters, such as phenolic or naphtholic compounds substituted with one or more hydroxyl groups, including but not limited to, for example, phenol, resorcinol, orcinol, catechol, pyrogallol, 2,4-dinitrophenol, 2,4,6-trinitrophenol, 4-chlororesorcinol, 2,4-dihydroxy toluene, 1,3-naphthalenediol, the sodium salt of 1-naphthol-4-sulfonic acid, o-fluorophenol, m-fluorophenol, p-fluorophenol, o-cresol, p-hydroxybenzotrifluoride, gallic acid, 1-naphthol, chlorophenol, hexyl resorcinol, chloromethylphenol, o-hydroxybenzotrifluoride, m-hydroxybenzotrifluoride, p-chloro-m-xylenol, and the like. Other examples of adhesion promoters include acrylic acid, benzyl alcohol, trichloroacetic acid, dichloroacetic acid, chloral hydrate, ethylene carbonate, and the like. These or other adhesion promoters may be used as a single adhesion promoter or as mixtures of two or more adhesion promoters.

Such primer layers may comprise one or more polymers. Often these include polymers of monomers having polar groups in the molecule such as carboxyl, carbonyl, hydroxy, sulfo, amino, amido, epoxy or acid anhydride groups, for example, acrylic acid, sodium acrylate, methacrylic acid, itaconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, or glycidyl methacrylate, or copolymers of the above monomers with other copolymerizable monomers. Additional examples are polymers of, for example, acrylic acid esters such as ethyl acrylate or butyl acrylate, methacrylic acid esters such as methyl methacrylate or ethyl methacrylate or copolymers of these monomers with other vinylic monomers; or copolymers of polycarboxylic acids such as itaconic acid, itaconic anhydride, maleic acid or maleic anhydride with vinylic monomers such as styrene, vinyl chloride, vinylidene chloride or butadiene, or trimers of these monomers with other ethylenically unsaturated monomers. Materials used in primer layers often comprise a copolymer containing a chloride group such as vinylidene chloride. In some embodiments, a terpolymer of monomers comprising about 83 wt % vinylidene chloride, about 15 wt % methyl acrylate, and about 2 wt % itaconic acid may be used, as described in U.S. Pat. No. 3,143,421 to Nadeau et al., which is hereby incorporated by reference in its entirety.

In some embodiments, the one or more polymers may be provided as a latex dispersion. Such a latex dispersion may be prepared by, for example, emulsion polymerization. In other embodiments, the one or polymers may be prepared by solution polymerization, followed by dispersion of the polymers in water to form a latex dispersion. Such polymers, when provided as a latex dispersion, may be referred to as latex polymers.

The one or more primer layer may optionally also comprise one or more surfactants, such as, for example, saponin. Such surfactants may be provided as part of one or more latex dispersions or may be provided in addition to any surfactants may be in such dispersions.

In some embodiments, the one or more primer layers may be applied to the transparent substrate prior to orientation of the substrate. Such orientation may comprise, for example, uniaxial or biaxial orientation at one or more temperatures above the glass transition temperature and below the melting temperature of the transparent substrate.

In embodiments comprising at least one subbing layer, such subbing layers may, for example, be applied to one or more surfaces of a transparent substrate or to one or more primer layers disposed on such surfaces. Generally, such subbing layers, when present, are adjacent to the one or more primer layers, when present, or are adjacent to one or more of the substrate surfaces, when the one or more primer layers are absent. In some embodiments, for example, where the one or more primer layers do not completely cover a substrate surface, the one or more subbing layer may be adjacent to both that substrate surface and to the one or more primer layers. In some embodiments, a subbing layer may comprise a coating thickness of about 0.143 $g/m^2$ on a dry basis.

In some embodiments, the one or more subbing layers may comprise gelatin, such as, for example, Regular Type IV bovine gelatin, alkali-treated gelatin, acid-treated gelatin, phthalate-modified gelatin, vinyl polymer-modified gelatin, acetylated gelatin, deionized gelatin, and the like.

Such subbing layers may comprise one or more polymers. In some embodiments, such polymers may comprise polymers of monomers comprising polar groups in the molecule such as carboxyl, carbonyl, hydroxy, sulfo, amino, amido, epoxy or acid anhydride groups, for example, acrylic acid, sodium acrylate, methacrylic acid, itaconic acid, crotonic acid, sorbic acid, itaconic anhydride, maleic anhydride, cinnamic acid, methyl vinyl ketone, hydroxyethyl acrylate, hydroxyethyl methacrylate, hydroxychloropropyl methacrylate, hydroxybutyl acrylate, vinylsulfonic acid, potassium vinylbenezensulfonate, acrylamide, N-methylamide, N-methylacrylamide, acryloylmorpholine, dimethylmethacrylamide, N-t-butylacrylamide, diacetonacrylamide, vinylpyrrolidone, glycidyl acrylate, or glycidyl methacrylate, or copolymers of the above monomers with other copolymerizable monomers. Additional examples are polymers of, for example, acrylic acid esters such as ethyl acrylate or butyl acrylate, methacrylic acid esters such as methyl methacrylate or ethyl methacrylate or copolymers of these monomers with other vinylic monomers; or copolymers of polycarboxylic acids such as itaconic acid, itaconic anhydride, maleic acid or maleic anhydride with vinylic monomers such as styrene, vinyl chloride, vinylidene chloride or butadiene, or trimers of these monomers with other ethylenically unsaturated monomers. In some embodiments, materials used in adhesion-promoting layers comprise polymers of one or more monomers containing a chloride group such as vinylidene chloride. In some embodiments, subbing layers may comprise one or more polymers comprising one or more polymeric matting agents. Such polymeric matting agents are described in U.S. Pat. No. 6,555,301 to Smith et al., which is hereby incorporated by reference in its entirety.

Such subbing layers may comprise one of more hardeners or crosslinking agents. In some embodiments, such hardeners may include, for example, 1,2-bis(vinylsulfonylacetamido) ethane, bis(vinylsulfonyl)methane, bis(vinylsulfonylmethyl) ether, bis(vinylsulfonylethyl)ether, 1,3-bis(vinylsulfonyl) propane, 1,3-bis(vinylsulfonyl)-2-hydroxypropane, 1,1,-bis (vinylsulfonyl)ethylbenzenesulfonate sodium salt, 1,1,1-tris (vinylsulfonyl)ethane, tetrakis(vinylsulfonyl)methane, tris (acrylamido)hexahydro-s-triazine, copoly(acrolein-methacrylic acid), glycidyl ethers, acrylamides, dialdehydes, blocked dialdehydes, alpha-diketones, active esters, sulfonate esters, active halogen compounds, s-triazines, diazines, epoxides, formaldehydes, formaldehyde condensation products anhydrides, aziridines, active olefins, blocked active olefins, mixed function hardeners such as halogen-substituted aldehyde acids, vinyl sulfones containing other hardening functional groups, 2,3-dihydroxy-1,4-dioxane, potassium chrome alum, polymeric hardeners such as polymeric aldehydes, polymeric vinylsulfones, polymeric blocked vinyl sulfones and polymeric active halogens.

Such subbing layers may comprise one or more surfactants. In some embodiments, such surfactants may include, for example, anionic surface active agents such as alkali metal or ammonium salts of alcohol sulfuric acid of 8 to 18 carbon atoms; ethanolamine lauryl sulfate; ethylaminolauryl sulfate; alkali metal and ammonium salts of paraffin oil; alkali metal salts of aromatic sulfonic acid such as dodecane-1-sulfonic acid, octadiene-1-sulfonic acid or the like; alkali metal salts such as sodium isopropylbenzene-sulfate, sodium isobutylnaphthalenesulfate or the like; and alkali metal or ammonium salts of esters of sulfonated dicarboxylic acid such as sodium dioctylsulfosuccinate, disodium dioctadecylsulfosuccinate or the like; nonionic surface active agents such as saponin, sorbitan alkyl esters, polyethylene oxides, polyoxyethylene alkyl ethers or the like; cationic surface active agents such as octadecyl ammonium chloride, trimethyldosecyl ammonium chloride or the like; and high molecular surface active agents other than those above mentioned such as polyvinyl alcohol, partially saponified vinyl acetates, maleic acid containing copolymers, or the like.

Such subbing layers may be coated from, for example, aqueous mixes. In some embodiments, a portion of the water in such mixes may be replaced by one or more water miscible solvents. Such solvents may include, for example, ketones such as acetone or methyl ethyl ketone, alcohols such as ethanol, methanol, isopropanol, n-propanol, and butanol, and the like.

In some embodiments, one or more subbing layers may comprise one or more polymers comprising one or more polymeric matting agents. Such polymeric matting agents are described in U.S. Pat. No. 6,555,301 to Smith et al., which is hereby incorporated by reference in its entirety. Polymeric matting agents may have an average particle sizes from, for example, about 1.2 to about 3 micrometers and glass transition temperatures of, for example, at least about 135° C. or of at least about 150° C., as indicated by, for example, the onset in the change of heat capacity as measured by differential scanning calorimetry at a scan rate of 20° C./min. In some embodiments, polymeric matting agents may comprise copolymers of (A) recurring units derived from one or more polyfunctional ethylenically unsaturated polymerizable acrylates or methacrylates, and (B) recurring units derived from one or more monofunctional ethylenically unsaturated polymerizable acrylates or methacrylates having only one polymerizable site. Such copolymers may have compositions comprising, for example, from about 10 to about 30 wt % of (A) recurring units and from about 70 to about 90 wt % of (B) recurring units. Such copolymers may have compositions comprising at least about 5 wt % (A) recurring units, or at least about 10 wt % (A) recurring units, or up to about 30 wt % (A) recurring units, or up to about 50 wt % (A) recurring units. Such copolymers may have compositions comprising at least about 50 wt % (B) recurring units, or at least about 70 wt % (B) recurring units, or up to about 90 wt % (B) recurring units or up to about 95 wt % (B) recurring units.

Ethylenically unsaturated monomers represented by (A) include ethylenically unsaturated polymerizable compounds that have two or more functional groups that can be polymerized or reacted to form crosslinking sites within the polymer matrix. Thus, such monomers are considered "polyfunctional" with respect to the moieties used for polymerization and crosslinking. Representative monomers of this type include but are not limited to, aromatic divinyl compounds (such as divinylbenzene, divinylnaphthalene, and derivatives thereof), diethylene carboxylate esters (that is, acrylate and methacrylates) and amides (such as ethylene glycol dimethacrylate, diethylene glycol dimethacrylate, triethylene glycol dimethacrylate, ethylene glycol diacrylate, diethylene glycol diacrylate, 1,6-hexanediol dimethacrylate, 1,6-hexanediol diacrylate, pentaerythritol tetraacrylate, neopentyl glycol dimethacrylate, allyl methacrylate, allyl acrylate, butenyl acrylate, undecenyl methacrylate, 1,4-butanediol dimethacrylate, trimethylol propane trimethacrylate, trimethylol propane triacylate, 1,3-dibutanediol dimethacrylate, methylene-bisacrylamide, and hexamethylene-bisacrylamide), dienes (such as butadiene and isoprene), other divinyl compounds such as divinyl sulfide and divinyl sulfone compounds, and other compounds that would be readily apparent to one skilled in the art. Two or more of these monomers can be used to prepare matting agents. The polyfunctional acrylates and methacrylates described above are preferred in the practice of this invention. Ethylene glycol dimethacrylate, 1,6-hexanediol dimethacrylate, 1,6-hexanediol diacrylate, trimethylol propane trimethacrylate, and trimethylol propane triacrylate are particularly preferred. Ethylene glycol dimethacrylate is most preferred.

Ethylenically unsaturated monomers represented by (B) include polymerizable compounds that only one functional group that can be polymerized or reacted to form crosslinking sites within the polymer matrix. These include any other known monomer that can be polymerized in suspension polymerization with the monomers defined by the (A) recurring units. Such monomers include but are not limited to, ethylenically unsaturated hydrocarbons (such as ethylene, propylene, 1-butene, isobutene, styrene, a-methylstyrene, m-chloromethylstyrene, vinyl toluene, vinyl naphthalene, p-methoxystyrene, and hydroxymethylstyrene), ethylenically unsaturated esters of carboxylic acids (such as vinyl acetate, vinyl propionate, vinyl benzoate, vinyl cinnamate, and vinyl butyrate), esters of ethylenically unsaturated mono- or dicarboxylic acid amides (such as acrylamide, methacrylamide, N-methylacrylamide, N-ethylacrylamide, N,N-dimethylacrylamide, N-n-butylacrylamide, N-t-butylacrylamide, itaconic acid diamide, acrylamido-2,2-dimethylpropanesulfonic acid, N-isopropylacrylamide, N-acryloylmorpholine, and N-acryloylpiperidine), monoethylenically unsaturated dicarboxylic acids and their salts (such as acrylic acid, methacrylic acid, itaconic acid, and their salts), monoethylenically unsaturated compounds such as acrylonitrile and methacrylonitrile, vinyl halides (such as vinyl chloride, vinyl fluoride, and vinyl bromide), vinyl ethers (such as vinyl methyl ether, vinyl isobutyl ether, and vinyl ethyl ether), vinyl ketones (such as vinyl methyl ketone, vinyl hexyl ketone, and methyl isopropenyl ketone), acrolein, vinylidene halides (such as vinylidene chloride and vinylidene chlorofluoride), N-vinyl compounds (such as N-vinyl pyrrolidone, N-vinyl pyrrole, N-vinyl carbazole, and N-vinyl indole), and alkyl or aryl esters, amides, and nitriles (that is acrylates and methacrylates, such as methyl methacrylate, methyl acrylate, ethyl methacrylate, ethyl acrylate, n-butyl methacrylate, isobutyl methacrylate, 2-hydroxyethyl acrylate, 2-hydroxyethyl methacrylate, hexyl acrylate, hexyl methacrylate, 2-ethylhexyl acrylate, nonyl methacrylate, benzyl methacrylate, 2-hydroxypropyl methacrylate, and amides and nitriles of the same acids), and other compounds that would be understood to one skilled in the art. Mixtures of such monomers can also be used. Acrylates and methacrylates are preferred monomers for obtaining the (B) recurring units. Methyl methacrylate, isobutyl methacrylate, and methyl acrylate are particularly preferred and methyl methacrylate is most preferred.

In some embodiments, polymeric matting agents are prepared using one or more polyfunctional acrylates or methacrylates and one or more monofunctional acrylates or methacrylates. Representative useful polymers are as follows (having weight ratios within the previously described ranges): poly(methyl methacrylate-co-ethylene glycol dimethacrylate), poly(methyl methacrylate-co-1,6-hexanediol diacrylate), poly(methyl acrylate-co-trimethylol propane triacrylate), poly(isobutyl methacrylate-co-ethylene glycol dimethacrylate), and poly(methyl acrylate-co-1,6-hexanediol diacrylate).

Exemplary Embodiments

U.S. Provisional Application No. 61/522,726, TRANSPARENT INK JET RECORDING FILMS, COMPOSITIONS, AND METHODS, filed Aug. 12, 2011, which is hereby incorporated by reference in its entirety, disclosed the following 18 non-limiting, exemplary embodiments:

A. A transparent ink-jet recording film comprising:

a transparent substrate comprising a polyester, said substrate comprising at least a first surface and a second surface;

at least one under-layer disposed on said first surface, said at least one under-layer comprising gelatin and at least one borate or borate derivative;

at least one image-receiving layer disposed on said at least one under-layer, said at least one image-receiving layer comprising at least one water soluble or water dispersible polymer and at least one inorganic particle, said at least one water soluble or water dispersible polymer comprising at least one hydroxyl group; and at least one back-coat layer disposed on said second surface, said at least one back-coat layer comprising gelatin and at least one polymer particle comprising at least one thermoplastic polymer, wherein said at least one polymer particle comprises a dry coverage of at least about 40 mg/m$^2$.

B. The transparent ink-jet recording film according to embodiment A, wherein the at least one polymer particle comprises at least one polymer comprising at least one acrylic or methacrylic repeat unit.

C. The transparent ink-jet recording film according to embodiment A, wherein the at least one polymer particle comprises poly(methyl methacrylate).

D. The transparent ink-jet recording film according to embodiment 1A, wherein the at least one polymer particle comprises a dry coverage of at least about 100 mg/m$^2$.

E. The transparent ink-jet recording film according to embodiment A, wherein the at least one particle comprises a mean diameter of at least about 5 μm and less than about 25 μm.

F. The transparent ink-jet recording film according to embodiment A, wherein the at least one back-coat layer further comprises at least one other hydrophilic colloid comprising at least one of sodium carboxymethylate casein or a polyacrylamide.

G. The transparent ink-jet recording film according to embodiment A, wherein the at least one back-coat layer further comprises sodium carboxymethylate casein and at least one polyacrylamide.

H. The transparent ink-jet recording film according to embodiment A, wherein the at least one back-coat layer further comprises at least one polysiloxane.

J. The transparent ink-jet recording film according to embodiment A, wherein the at least one back-coat layer comprises at least one first layer and at least one second layer, said at least one first layer being disposed between said at least one second layer and the second surface of the transparent substrate, wherein said at least one first layer comprises gelatin and at least one hardener, and said at least one second layer comprises gelatin and the at least one polymer particle.

K. The transparent ink-jet recording film according to embodiment J, wherein the at least one second layer further comprises at least one other hydrophilic colloid comprising at least one of sodium carboxymethylate casein or a polyacrylamide.

L. The transparent ink-jet recording film according to embodiment J, wherein the at least one second layer further comprises sodium carboxymethylate casein and at least one polyacrylamide.

M. The transparent ink-jet recording film according to embodiment J, wherein the at least one second layer further comprises at least one polysiloxane.

N. The transparent ink-jet recording film according to embodiment J, wherein the at least one hardener comprises bis(vinylsulfonyl)methane.

P. The transparent ink-jet recording film according to embodiment A, wherein the at least one inorganic particle comprises boehmite alumina.

Q. The transparent ink-jet recording film according to embodiment A, wherein the at least one borate or borate derivative comprises at least one hydrate of sodium tetraborate.

R. The transparent ink-jet recording film according to embodiment A, wherein the at least one water soluble or water dispersible polymer comprises poly(vinyl alcohol).

S. The transparent ink-jet recording film according to embodiment A comprising an ink transfer measurement of less than about two squares transferred when subjected to 0.081 psi pressure and 85% relative humidity for seven days, wherein said ink transfer measurement is based on 390 ⅛-in×⅛-in grid squares.

T. The transparent ink-jet recording film according to embodiment A comprising an ink transfer measurement of less than about 31 squares transferred when subjected to 5.7 psi pressure and 86% relative humidity for seven days, wherein said ink transfer measurement is based 390 ⅛-in×⅛-in grid squares.

EXAMPLES

Materials

Materials used in the examples were available from Aldrich Chemical Co., Milwaukee, unless otherwise specified.

Boehmite is an aluminum oxide hydroxide (γ-AlO(OH)).

Borax is sodium tetraborate decahydrate.

CELVOL® 540 is a poly(vinyl alcohol) that is 87-89.9% hydrolyzed, with 140,000-186,000 weight-average molecular weight. It is available from Sekisui Specialty Chemicals America, LLC, Dallas, Tex.

DISPERAL® HP-14 is a dispersible boehmite alumina powder with high porosity and a particle size of 14 nm. It is available from Sasol North America, Inc., Houston, Tex.

Gelatin is a Regular Type IV bovine gelatin. It is available as Catalog No. 8256786 from Eastman Gelatine Corporation, Peabody, Mass.

KATHON® LX is a microbiocide. It is available from Dow Chemical.

Silica coated polymer beads were prepared using SAA-1200 styrene allyl alcohol copolymer beads (Lyondell Chemical) and LUDOX® 6.7 micron colloidal silica particles (DuPont), as described in U.S. Pat. Nos. 4,833,060, 5,354,799, and 6,457,824, each of which is hereby incorporated by reference in its entirety.

SPHEROMERS® CA10 are crosslinked poly(methyl methacrylate) beads having a stated mean diameter of 10 μm, with stated coefficient of variation less than 5%. They are available from Microbeads AS, Skedsmokorset, Norway.

SPHEROMERS® CA15 are crosslinked poly(methyl methacrylate) beads having a stated mean diameter of 15 μm, with stated coefficient of variation less than 5%. They are available from Microbeads AS, Skedsmokorset, Norway.

Surfactant 10G is an aqueous solution of nonyl phenol, glycidyl polyether. It is available from Dixie Chemical Co., Houston, Tex.

VERSA-TL 502 is a sulfonated polystyrene (1,000,000 molecular weight). It is available from AkzoNobel.

Methods

Evaluation of Samples for Ink Transfer

Coated films were equilibrated at about 85% relative humidity for at least 16 hrs, and then were imaged at about 85% relative humidity with an EPSON® 4900 ink-jet printer using an image having a 4-in×7.76-in block having an optical density of at least 2.8. Immediately after printing, the films were removed from the printer and laid flat, receptor side up. Coated films were placed over the printed films, so that the receptor sides of the printed films contacted the backsides of the coated films covering them. Weights were applied over the covering films, so as to apply a pressure of either about 0.081 psi (560 Pa) or about 5.7 psi (39 kPa) to the films. The films were left under pressure for 7 days at about 85% relative humidity, after which the weights were removed. The films were carefully separated and inspected for ink-transfer from the receptor sides of the printed films to the backcoat sides of the covering films, by placing a transparent 390-square grid over the printed films and counting the number of ⅛-in×⅛-in squares having low print density ("squares transferred").

Evaluation of Samples for Haze

Haze (%) was measured in accord with ASTM D 1003 by conventional means using a HAZE-GARD PLUS Hazemeter (BYK-Gardner, Columbia, Md.).

Example 1(Comparative)

Preparation of Bottom Back-Layer Coating Mix

To a mixing vessel, 4322 parts by weight of demineralized water was introduced. 240 parts of gelatin was added to the agitated vessel and allowed to swell. The mix was heated to 50° C., held for 15 min, and then cooled to 43° C. To the resulting mixture was added 10 parts of a 25 wt % aqueous solution of caustic, which was allowed to mix for 2 min. The resulting mixture was heated to 40° C. The pH of the mix was then checked to be between 7.2-7.4 and adjusted if too high or too low by adding aqueous solutions of nitric or caustic, respectively. To the resulting mixture was added 27 parts of an aqueous solution comprising 12 wt % VERSA-TL 502, 99 ppm KATHON® LX, and 80 ppb cupric(II) nitrate hemipentahydrate, which was allowed to mix for 5 min.

Preparation of Middle Back-Layer Coating Mix

To a mixing vessel, 4172 parts by weight of demineralized water was introduced. 314 parts of gelatin was added to the agitated vessel and allowed to swell. The mix was heated to 50° C., held for 15 min, and then cooled to 43° C. To this mixture was added 13 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Preparation of Top Back-Layer Coating Mix

To a mixing vessel, 2035 parts by weight of demineralized water was introduced. 118 parts of gelatin and 253 parts of an aqueous mixture comprising 9 wt % gelatin and 8 wt % silica coated polymer beads were added to the agitated vessel. The mix was heated to 50° C., held for 15 min, and then cooled to 43° C. To this mixture was added 146 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 101 parts of a 28 wt % aqueous solution of polyacrylamide and 23 parts of a 2.2 wt % aqueous solution of chrome alum, which was allowed to mix for 3 min. To the resulting mixture was added 186 parts of an aqueous solution comprising 20 wt % surfactants, 9 wt % gelatin, and 9 wt % silicone, which was allowed to mix for 10 min. To this mixture was added 117 parts of an aqueous solution comprising 36 wt % surfactant and 3 wt % propionic acid, 6 parts demineralized water, 5 parts of an aqueous solution comprising 21 wt % n-propyl alcohol and 8 wt % surfactant, and 10 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Preparation of Back-Layer Coated Webs

The bottom, middle, and top back-layer coating mixes were heated to 40° C. and applied continuously to a polyethylene terephthalate web, which were moving at a speed of 90 ft/min. (The bottom layer was the one closest to the web, while the top layer was the one farthest from the web.) The bottom back-layer coating mix feed rate was 26.8 g/m$^2$, the middle back-layer coating mix feed rate was 20.0 g/m$^2$, and the top back-layer coating mix feed rate was 14.7 g/m$^2$, resulting in a dry back-layer coating weight of 4.2 g/m$^2$ and a dry coverage of silica coated polymer beads of 100 mg/m$^2$. The coated webs were dried continuously by moving past perforated plates through which room temperature air flowed. The pressure drop across the perforated plates was in the range of 0.8 to 3 in $H_2O$. The air dew point was in the range of 7 to 13° C.

A 1.8 wt % aqueous solution of bis(vinylsulfonyl)methane (BVSM) was also prepared. This solution was in-line mixed with the back-coat interlayer mix as it was being coated, at a feed rate of 10.5 g/m$^2$, so that the overall amount of BVSM applied was 2% of the total gelatin in the three back-coat layers.

Preparation of Gelatin Under-Layer Coating Mix

To a mixing vessel, 273 parts by weight of demineralized water was introduced. 14.4 parts of gelatin was added to the agitated vessel and allowed to swell. This mix was heated to 60° C. and held until the gelatin was fully dissolved. The mix was then cooled to 50° C. To this mix, 6.48 parts of borax (sodium tetraborate decahydrate) was added and mixed until the borax was fully dissolved. To this mix, 1.62 parts of an aqueous solution of 12 wt % sulfonated polystyrene (VERSA-TL® 502, AkzoNobel) and 0.2 wt % microbiocide (KATHON® LX, Dow) was added and mixed until homogeneous. The mix was then cooled to 40° C. 4.91 parts of a 10 wt % aqueous solution of nonyl phenol, glycidyl polyether (Surfactant 10G) was then added and mixed until homogeneous. This mix was cooled to room temperature and held to allow disengagement of any gas bubbles prior to use. The weight ratio of borax to gelatin in the resulting under-layer coating mix was 0.45:1.

Preparation of Under-layer Coated Webs

The under-layer coating mix was heated to 40° C. and applied continuously to the back-layer coated polyethylene terephthalate webs, which were moving at a speed of 90 ft/min. This coating was applied to the side opposite that to which the back-layer coating had been applied. The under-layer coating mix feed rate was 82 g/m$^2$, resulting in a dry under-layer coating weight of 5.4 g/m$^2$. The coated webs were dried continuously by moving past perforated plates through which room temperature air flowed. The pressure drop across the perforated plates was in the range of 0.8 to 3 in $H_2O$. The air dew point was in the range of 7 to 13° C.

Preparation of Poly(vinyl alcohol) Mix

A poly(vinyl alcohol) mix was prepared at room temperature by adding 400 parts by weight of poly(vinyl alcohol) (CELVOL® 540) to a mixing vessel containing 3600 parts demineralized water over 10 min with 500 rpm agitation. This mixture was heated to 85° C. and agitated for 30 minutes. The mixture was then allowed to cool to room temperature. Dimineralized water was added to make up for water lost due to evaporation.

Preparation of Alumina Mix

An alumina mix was prepared at room temperature by mixing 220 parts by weight of a 22 wt % aqueous solution of nitric acid and 8030 parts of demineralized water. To this mix, 2750 parts of alumina powder (DISPERAL® HP-14) was added over 30 min. The pH of the mix was adjusted to 2.56 by adding additional nitric acid solution. The mix was heated to 80° C. and stirred for 30 min. The mix was cooled to room temperature and held for gas bubble disengagement prior to use.

Preparation of Image-Receiving Layer Coating Mix

An image-receiving coating mix was prepared at room temperature by introducing 7.13 parts by weight of the 10 wt % aqueous solution of poly(vinyl alcohol) (CELVOL® 540) into a mixing vessel and agitating. To this mix, 32.8 parts of the alumina mix and 0.660 parts of a 10 wt % aqueous solution of nonyl phenol, glycidyl polyether (Surfactant 10G) were added. The mix was cooled to room temperature and held for gas bubble disengagement prior to use.

Preparation of Image-Receiving Layer Coated Film

The image-coating mix was heated to 40° C. and coated onto the under-layer coated surface of a room temperature polyethylene terephthalate web, which was moving at a speed of 65 ft/min. The image-receiving layer coating mix feed rate was 446.4 g/min, resulting in a dry image-receiving layer coating weight of 49 g/m$^2$. The coated film was dried continuously by moving past perforated plates through which room temperature air flowed. The pressure drop across the perforated plates was in the range of 0.8 to 3 in $H_2O$. The air dew point was in the range of 7 to 13° C.

Evaluation of Coated Film

The results of the film evaluation are shown in Table I.

Example 2

The procedure of Example 1 was repeated, but using the following top back-layer coating mix. Use this mix resulted in a dry back-layer coating weight of 4.2 g/m$^2$ and a dry coverage of 10 μm diameter poly(methyl methacrylate) (PMMA) beads of 100 mg/m$^2$.

Preparation of Top Back-Layer Coating Mix

To a mixing vessel, 2047 parts by weight of demineralized water was introduced. 119 parts of gelatin and 241 parts of an aqueous mixture comprising 9.0 wt % gelatin and 8.5 wt % PMMA beads having 10 μm mean diameter (SPHEROMERS® CA10) were added to the agitated vessel. The mix was heated to 50° C., held for 15 min, and then cooled to 43° C. To this mixture was added 146 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 101 parts of a 28 wt % aqueous solution of polyacrylamide and 23 parts of a 2.2 wt % aqueous solution of chrome alum, which was allowed to mix for 3 min. To the resulting mixture was added 186 parts of an aqueous solution comprising 20 wt % surfactants, 9 wt % gelatin, and 9 wt % silicone, which was allowed to mix for 10 min. To this mixture was added 117 parts of an aqueous solution comprising 36 wt % surfactant and 3 wt % propionic acid, 6 parts demineralized water, 5 parts of an aqueous solution comprising 21 wt % n-propyl alcohol and 8 wt % surfactant, and 10 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Evaluation of Coated Film

The results of the film evaluation are shown in Table I. Ink transfer and haze were improved compared to Comparative Example 1.

Example 3

The procedure of Example 1 was repeated, but using the following top back-layer coating mix. Use this mix resulted in a dry back-layer coating weight of 3.9 g/m$^2$ and a dry coverage of 15 μm diameter poly(methyl methacrylate) (PMMA) beads of 100 mg/m$^2$.

Preparation of Top Back-Layer Coating Mix

To a mixing vessel, 2047 parts by weight of demineralized water was introduced. 119 parts of gelatin and 241 parts of an aqueous mixture comprising 9.0 wt % gelatin and 8.5 wt % PMMA beads having 15 μm mean diameter (SPHEROMERS® CA15) were added to the agitated vessel. The mix was heated to 50° C., held for 15 min, and then cooled to 43° C. To this mixture was added 146 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 101 parts of a 28 wt % aqueous solution of polyacrylamide and 23 parts of a 2.2 wt % aqueous solution of chrome alum, which was allowed to mix for 3 min. To the resulting mixture was added 186 parts of an aqueous solution comprising 20 wt % surfactants, 9 wt % gelatin, and 9 wt % silicone, which was allowed to mix for 10 min. To this mixture was added 117 parts of an aqueous solution comprising 36 wt % surfactant and 3 wt % propionic acid, 6 parts demineralized water, 5 parts of an aqueous solution comprising 21 wt % n-propyl alcohol and 8 wt % surfactant, and 10 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Evaluation of Coated Film

The results of the film evaluation are shown in Table I. Ink transfer and haze were improved compared to Comparative Example 1.

Example 4 (Comparative)

Preparation of Bottom Back-Layer Coating Mix

To a mixing vessel, 5826 parts by weight of dematerialized water was introduced. 324 parts of gelatin was added to the agitated vessel and allowed to swell. The mix was heated to 50° C., held for 15 min, and then cooled to 43° C. To the resulting mixture was added 13.6 parts of a 25 wt % aqueous solution of caustic, which was allowed to mix for 2 min. The resulting mixture was heated to 40° C. The pH of the mix was then checked to be between 7.2-7.4 and adjusted if too high or too low by adding aqueous solutions of nitric or caustic, respectively. To the resulting mixture was added 36.4 parts of an aqueous solution comprising 12 wt % VERSA-TL® 502, 99 ppm KATHON® LX, and 80 ppb cupric(II) nitrate hemipentahydrate, which was allowed to mix for 5 min.

Preparation of Middle Back-Layer Coating Mix

To a mixing vessel, 5025 parts by weight of dematerialized water was introduced. 379 parts of gelatin was added to the agitated vessel and allowed to swell. The mix was heated to 50° C., held for 15 min, and then cooled to 43° C. To this mixture was added 15.9 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Preparation of Top Back-Layer Coating Mix

To a mixing vessel, 1798 parts by weight of dematerialized water was introduced. 104 parts of gelatin and 224 parts of an aqueous mixture comprising 9 wt % gelatin and 8 wt % silica coated polymer beads were added to the agitated vessel. The mix was heated to 50° C., held for 15 min, and then cooled to 43° C. To this mixture was added 129 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 89 parts of a 28 wt % aqueous solution of polyacrylamide and 20 parts of a 2.2 wt % aqueous solution of chrome alum, which was allowed to mix for 3 min. To the resulting mixture was added 164 parts of an aqueous solution comprising 20 wt % surfactants, 9 wt % gelatin, and 9 wt % silicone, which was allowed to mix for 10 min. To this mixture was added 103 parts of an aqueous solution comprising 36 wt % surfactant and 3 wt % propionic acid, 5 parts dematerialized water, 5 parts of an aqueous solution comprising 21 wt % n-propyl alcohol and 8 wt % surfactant, and 9 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Preparation of Back-Layer Coated Web

The bottom, middle, and top back-layer coating mixes were heated to 40° C. and applied continuously to a first polyethylene terephthalate web, which were moving at a speed of 90 ft/min. (The bottom layer was the one closest to the web, while the top layer was the one farthest from the web.) The bottom back-layer coating mix feed rate was 26.8 g/m$^2$, the middle back-layer coating mix feed rate was 20.0 g/m$^2$, and the top back-layer coating mix feed rate was 14.7 g/m$^2$, resulting in a dry back-layer coating weight of 4.0 g/m$^2$ and a dry coverage of silica coated polymer beads of 100 mg/m$^2$. The first coated webs were dried continuously by moving past perforated plates through which room temperature air flowed. The pressure drop across the perforated plates was in the range of 0.8 to 3 in $H_2O$. The air dew point was in the range of 7 to 13° C.

A 1.8 wt % aqueous solution of bis(vinylsulfonyl)methane (BVSM) was also prepared. This solution was in-line mixed with the back-coat interlayer mix as it was being coated, at a feed rate of 10.5 g/m$^2$, so that the overall amount of BVSM applied was 2% of the total gelatin in the three back-coat layers.

Preparation of Under-Layer and Image-Receiving Layer Coated Film

Under-layer and image-receiving layer coating mixes were prepared and applied to a second web according to the procedure of Example 19 of U.S. patent application Ser. No. 13/273,260, "TRANSPARENT INK-JET RECORDING FILMS, COMPOSITIONS, AND METHODS," filed Oct. 14, 2011, which is hereby incorporated by reference in its entirety. The dry coating weights of the under-layer and image-receiving layer were 5.4 g/m$^2$ and 48.5 g/m$^2$, respectively.

Evaluation of Coated Film

The two sets of coated films (the first having applied back-coat layers and the second having applied under-layers and image-receiving layers) were equilibrated at about 85% relative humidity for at least 16 hrs. The second set of films were imaged at about 85% relative humidity with an EPSON® 4900 ink-jet printer using an image having a 4-in×7.76-in block having an optical density of at least 2.8. Immediately after printing, the printed films were removed from the printer and laid flat, receptor side up. One of the first set of films was placed over each of the printed films, so that the receptor sides of the printed films contacted the backsides of the coated films covering them. Weights were applied over the covering films, so as to apply a pressure of about 5.7 psi (39 kPa) to the films. The films were left under pressure for 7 days at about 85% relative humidity, after which the weights were removed. The films were carefully separated and inspected for ink-transfer from the receptor sides of the printed films to the backcoat sides of the covering films, by placing a transparent 390-square grid over the printed films and counting the number of ⅛-in×⅛-in squares having low print density ("squares transferred"). The results of the film evaluation are shown in Table II.

Example 5 (Comparative)

The procedure of Example 4 was repeated, but using the following top back-layer coating mix.

Preparation of Top Back-Layer Coating Mix

To a mixing vessel, 1476 parts by weight of dematerialized water was introduced. 84 parts of gelatin and 236 parts of an aqueous mixture comprising 9 wt % gelatin and 8 wt % silica coated polymer beads were added to the agitated vessel. The mix was heated to 50° C., held for 15 min, and then cooled to 43° C. To this mixture was added 109 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 75 parts of a 28 wt % aqueous solution of polyacrylamide and 17 parts of a 2.2 wt % aqueous solution of chrome alum, which was allowed to mix for 3 min. To the resulting mixture was added 139 parts of an aqueous solution comprising 20 wt % surfactants, 9 wt % gelatin, and 9 wt % silicone, which was allowed to mix for 10 min. To this mixture was added 87 parts of an aqueous solution comprising 36 wt % surfactant and 3 wt % propionic acid, 4 parts dematerialized water, 4 parts of an aqueous solution comprising 21 wt % n-propyl alcohol and 8 wt % surfactant, and 8 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Use of this mix resulted in a dry back-layer coating weight of 4.0 g/m$^2$ and a dry coverage of silica coated polymer beads of 125 mg/m$^2$.

Evaluation of Coated Film

The printed films were evaluated with an applied pressure of about 5.7 psi (39 kPa). The results of the film evaluation are shown in Table II.

Example 6

The procedure of Example 4 was repeated, but using the following top back-layer coating mix.

Preparation of Top Back-Layer Coating Mix

To a mixing vessel, 1561 parts by weight of dematerialized water was introduced. 92 parts of gelatin and 144 parts of an aqueous mixture comprising 9.0 wt % gelatin and 8.5 wt % PMMA beads having 10 μm mean diameter (SPHEROMERS® CA10) were added to the agitated vessel. The mix was heated to 50° C., held for 15 min, and then cooled to 43° C. To this mixture was added 109 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 76 parts of a 28 wt % aqueous solution of polyacrylamide and 17 parts of a 2.2 wt % aqueous solution of chrome alum, which was allowed to mix for 3 min. To the resulting mixture was added 139 parts of an aqueous solution comprising 20 wt % surfactants, 9 wt % gelatin, and 9 wt % silicone, which was allowed to mix for 10 min. To this mixture was added 87 parts of an aqueous solution comprising 36 wt % surfactant and 3 wt % propionic acid, 4 parts dematerialized water, 4 parts of an aqueous solution comprising 21 wt % n-propyl alcohol and 8 wt % surfactant, and 8 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Use of this mix resulted in a dry back-layer coating weight of 4.0 g/m$^2$ and a dry coverage of 10 μm diameter poly(methyl methacrylate) (PMMA) beads of 80 mg/m$^2$.

Evaluation of Coated Film

The printed films were evaluated with an applied pressure of about 5.7 psi (39 kPa). The results of the film evaluation are shown in Table II. Ink transfer and haze were improved compared to Comparative Examples 4 and 5.

Example 7

The procedure of Example 4 was repeated, but using the following top back-layer coating mix.

Preparation of Top Back-Layer Coating Mix

To a mixing vessel, 1528 parts by weight of dematerialized water was introduced. 89 parts of gelatin and 180 parts of an aqueous mixture comprising 9.0 wt % gelatin and 8.5 wt % PMMA beads having 10 μm mean diameter (SPHEROMERS® CA10) were added to the agitated vessel. The mix was heated to 50° C., held for 15 min, and then cooled to 43°

C. To this mixture was added 109 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 76 parts of a 28 wt % aqueous solution of polyacrylamide and 17 parts of a 2.2 wt % aqueous solution of chrome alum, which was allowed to mix for 3 min. To the resulting mixture was added 139 parts of an aqueous solution comprising 20 wt % surfactants, 9 wt % gelatin, and 9 wt % silicone, which was allowed to mix for 10 min. To this mixture was added 87 parts of an aqueous solution comprising 36 wt % surfactant and 3 wt % propionic acid, 4 parts dematerialized water, 4 parts of an aqueous solution comprising 21 wt % n-propyl alcohol and 8 wt % surfactant, and 8 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Use of this mix resulted in a dry back-layer coating weight of 4.0 g/m$^2$ and a dry coverage of 10 μm diameter poly(methyl methacrylate) (PMMA) beads of 100 mg/m$^2$.

Evaluation of Coated Film

The printed films were evaluated with an applied pressure of about 5.7 psi (39 kPa). The results of the film evaluation are shown in Table II. Ink transfer and haze were improved compared to Comparative Examples 4 and 5.

Example 8

The procedure of Example 4 was repeated, but using the following top back-layer coating mix.

Preparation of Top Back-Layer Coating Mix

To a mixing vessel, 1487 parts by weight of dematerialized water was introduced. 85 parts of gelatin and 225 parts of an aqueous mixture comprising 9.0 wt % gelatin and 8.5 wt % PMMA beads having 10 μm mean diameter (SPHEROMERS® CA10) were added to the agitated vessel. The mix was heated to 50° C., held for 15 min, and then cooled to 43° C. To this mixture was added 109 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 76 parts of a 28 wt % aqueous solution of polyacrylamide and 17 parts of a 2.2 wt % aqueous solution of chrome alum, which was allowed to mix for 3 min. To the resulting mixture was added 139 parts of an aqueous solution comprising 20 wt % surfactants, 9 wt % gelatin, and 9 wt % silicone, which was allowed to mix for 10 min. To this mixture was added 87 parts of an aqueous solution comprising 36 wt % surfactant and 3 wt % propionic acid, 4 parts dematerialized water, 4 parts of an aqueous solution comprising 21 wt % n-propyl alcohol and 8 wt % surfactant, and 8 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Use of this mix resulted in a dry back-layer coating weight of 4.2 g/m$^2$ and a dry coverage of 10 μm diameter poly(methyl methacrylate) (PMMA) beads of 125 mg/m$^2$.

Evaluation of Coated Film

The printed films were evaluated with an applied pressure of about 5.7 psi (39 kPa). The results of the film evaluation are shown in Table II. Ink transfer and haze were improved compared to Comparative Examples 4 and 5.

Example 9

The procedure of Example 4 was repeated, but using the following top back-layer coating mix.

Preparation of Top Back-Layer Coating Mix

To a mixing vessel, 1561 parts by weight of dematerialized water was introduced. 92 parts of gelatin and 144 parts of an aqueous mixture comprising 9.0 wt % gelatin and 8.5 wt % PMMA beads having 15 μm mean diameter (SPHEROMERS® CA15) were added to the agitated vessel. The mix was heated to 50° C., held for 15 min, and then cooled to 43° C. To this mixture was added 109 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 76 parts of a 28 wt % aqueous solution of polyacrylamide and 17 parts of a 2.2 wt % aqueous solution of chrome alum, which was allowed to mix for 3 min. To the resulting mixture was added 139 parts of an aqueous solution comprising 20 wt % surfactants, 9 wt % gelatin, and 9 wt % silicone, which was allowed to mix for 10 min. To this mixture was added 87 parts of an aqueous solution comprising 36 wt % surfactant and 3 wt % propionic acid, 4 parts dematerialized water, 4 parts of an aqueous solution comprising 21 wt % n-propyl alcohol and 8 wt % surfactant, and 8 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Use of this mix resulted in a dry back-layer coating weight of 3.8 g/m$^2$ and a dry coverage of 15 μm diameter poly(methyl methacrylate) (PMMA) beads of 80 mg/m$^2$.

Evaluation of Coated Film

The printed films were evaluated with an applied pressure of about 5.7 psi (39 kPa). The results of the film evaluation are shown in Table II. Ink transfer and haze were improved compared to Comparative Example 4.

Example 10

The procedure of Example 4 was repeated, but using the following top back-layer coating mix.

Preparation of Top Back-Layer Coating Mix

To a mixing vessel, 1528 parts by weight of dematerialized water was introduced. 89 parts of gelatin and 180 parts of an aqueous mixture comprising 9.0 wt % gelatin and 8.5 wt % PMMA beads having 15 μm mean diameter (SPHEROMERS® CA15) were added to the agitated vessel. The mix was heated to 50° C., held for 15 min, and then cooled to 43° C. To this mixture was added 109 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 76 parts of a 28 wt % aqueous solution of polyacrylamide and 17 parts of a 2.2 wt % aqueous solution of chrome alum, which was allowed to mix for 3 min. To the resulting mixture was added 139 parts of an aqueous solution comprising 20 wt % surfactants, 9 wt % gelatin, and 9 wt % silicone, which was allowed to mix for 10 min. To this mixture was added 87 parts of an aqueous solution comprising 36 wt % surfactant and 3 wt % propionic acid, 4 parts dematerialized water, 4 parts of an aqueous solution comprising 21 wt % n-propyl alcohol and 8 wt % surfactant, and 8 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Use this mix resulted in a dry back-layer coating weight of 4.0 g/m$^2$ and a dry coverage of 15 μm diameter poly(methyl methacrylate) (PMMA) beads of 100 mg/m$^2$.

Evaluation of Coated Film

The printed films were evaluated with an applied pressure of about 5.7 psi (39 kPa). The results of the film evaluation are shown in Table II. Ink transfer and haze were improved compared to Comparative Examples 4 and 5.

Example 11

The procedure of Example 4 was repeated, but using the following top back-layer coating mix.

Preparation of Top Back-Layer Coating Mix

To a mixing vessel, 1487 parts by weight of dematerialized water was introduced. 85 parts of gelatin and 224 parts of an aqueous mixture comprising 9.0 wt % gelatin and 8.5 wt % PMMA beads having 15 μm mean diameter (SPHEROMERS® CA15) were added to the agitated vessel. The mix was heated to 50° C., held for 15 min, and then cooled to 43° C. To this mixture was added 109 parts of a solution comprising 87.4 wt % sodium carboxymethylate casein, 8.0 wt % gelatin, 4.4 wt % water, and 0.2 wt % surfactant, which was allowed to mix for 10 min. To the resulting mixture was added 76 parts of a 28 wt % aqueous solution of polyacrylamide and 17 parts of a 2.2 wt % aqueous solution of chrome alum, which was allowed to mix for 3 min. To the resulting mixture was added 139 parts of an aqueous solution comprising 20 wt % surfactants, 9 wt % gelatin, and 9 wt % silicone, which was allowed to mix for 10 min. To this mixture was added 87 parts of an aqueous solution comprising 36 wt % surfactant and 3 wt % propionic acid, 4 parts dematerialized water, 4 parts of an aqueous solution comprising 21 wt % n-propyl alcohol and 8 wt % surfactant, and 8 parts of a 25 wt % aqueous solution of caustic, which was allowed to mix for 3 min. The resulting mixture was heated to 40° C. The pH of the mix was then checked to be between 7.2-7.4 and adjusted if too high or too low by adding aqueous solutions of nitric or caustic, respectively.

Use of this mix resulted in a dry back-layer coating weight of 4.0 g/m$^2$ and a dry coverage of 15 μm diameter poly(methyl methacrylate) (PMMA) beads of 125 mg/m$^2$.

Evaluation of Coated Film

The printed films were evaluated with an applied pressure of about 5.7 psi (39 kPa). The results of the film evaluation are shown in Table II. Ink transfer and haze were improved compared to Comparative Examples 4 and 5.

The invention has been described in detail with reference to particular embodiments, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

TABLE I

| Ex. | Backcoat Bead Type | Ink Transfer (0.081 psi) | Ink Transfer (5.7 psi) | Percent Haze |
|---|---|---|---|---|
| 1 | Core/Shell acrylic/silica | 2.5 | 31.5 | 38.1 |
| 2 | 10 μm PMMA | 0.0 | 6.0 | 32.3 |
| 3 | 15 μm PMMA | 0.0 | 2.0 | 30.8 |

Notes:
1. All beads present in backcoat at 100 mg/m$^2$.
2. Upon printing at 20° C. and 84-86% relative humidity, the first wedges of all the samples were 75% wet, the second wedges were all 25% wet, and the third wedges were all 12.5% wet.
3. Ink Transfer measurements conducted at 20° C. and 86%, with ⅛-in × ⅛-in size grid squares.

TABLE II

| Ex. | Backcoat Bead Type | Coating Weight of Beads (mg/m$^2$) | Ink Transfer (5.7 psi) | Percent Haze |
|---|---|---|---|---|
| 4 | Core/Shell acrylic/silica | 100 | 18.0 | 31.1 |
| 5 | Core/Shell acrylic/silica | 125 | 9.0 | 32.8 |
| 6 | 10 μm PMMA | 80 | 4.0 | 28.1 |
| 7 | 10 μm PMMA | 100 | 4.0 | 28.9 |
| 8 | 10 μm PMMA | 125 | 2.0 | 29.8 |
| 9 | 15 μm PMMA | 80 | 12.0 | 27.5 |
| 10 | 15 μm PMMA | 100 | 5.0 | 28.4 |
| 11 | 15 μm PMMA | 125 | 3.0 | 29.5 |

Notes:
1. Ink Transfer measurements conducted at 20° C. and 85% to 91% relative humidity, with ⅛-in × ⅛-in size grid squares.

What is claimed:

1. A transparent ink-jet recording film comprising:

a transparent substrate comprising a polyester, said substrate comprising at least a first surface and a second surface;

at least one under-layer disposed on said first surface, said at least one under-layer comprising gelatin and at least one borate or borate derivative;

at least one image-receiving layer disposed on said at least one under-layer, said at least one image-receiving layer comprising at least one water soluble or water dispersible polymer and at least one inorganic particle, said at least one water soluble or water dispersible polymer comprising at least one hydroxyl group; and at least one back-coat layer disposed on said second surface, said at least one back-coat layer comprising gelatin, at least one polymer particle comprising at least one thermoplastic polymer, and at least one other hydrophilic colloid comprising at least one of sodium carboxymethylate casein or a polyacrylamide, wherein said at least one polymer particle comprises a dry coverage of at least about 40 mg/m$^2$.

2. The transparent ink-jet recording film according to claim 1, wherein the at least one polymer particle comprises at least one polymer comprising at least one acrylic or methacrylic repeat unit.

3. The transparent ink jet recording film according to claim 1, wherein the at least one polymer particle comprises poly (methyl methacrylate).

4. The transparent ink-jet recording film according to claim 1, wherein the at least one polymer particle comprises a dry coverage of at least about 100 $mg/m^2$.

5. The transparent ink-jet recording film according to claim 1, wherein the at least one particle comprises a mean diameter of at least about 5 μm and less than about 25 μm.

6. The transparent ink-jet recording film according to claim 1, wherein the at least one back-coat layer comprises sodium carboxymethylate casein and at least one polyacrylamide.

7. The transparent ink jet recording film according to claim 1, wherein the at least one back-coat layer further comprises at least one polysiloxane.

8. The transparent ink-jet recording film according to claim 1, wherein the at least one back-coat layer comprises at least one first layer and at least one second layer, said at least one first layer being disposed between said at least one second layer and the second surface of the transparent substrate, wherein said at least one first layer comprises gelatin and at least one hardener, and said at least one second layer comprises gelatin and the at least one polymer particle.

9. The transparent ink-jet recording film according to claim 8, wherein the at least one second layer further comprises at least one other hydrophilic colloid comprising at least one of sodium carboxymethylate casein or a polyacrylamide.

10. The transparent ink jet recording film according to claim 8, wherein the at least one second layer further comprises sodium carboxymethylate casein and at least one polyacrylamide.

11. The transparent ink jet recording film according to claim 8, wherein the at least one second layer further comprises at least one polysiloxane.

12. The transparent ink-jet recording film according to claim 8, wherein the at least one hardener comprises bis (vinylsulfonyl)methane.

13. The transparent ink jet recording film according to claim 1, wherein the at least one inorganic particle comprises boehmite alumina.

14. The transparent ink-jet recording film according to claim 1, wherein the at least one borate or borate derivative comprises at least one hydrate of sodium tetraborate.

15. The transparent ink-jet recording film according to claim 1, wherein the at least one water soluble or water dispersible polymer comprises poly(vinyl alcohol).

16. The transparent ink-jet recording film according to claim 1 comprising an ink transfer measurement of less than about two squares transferred when subjected to 0.081 psi pressure and 85% relative humidity for seven days, wherein said ink transfer measurement is based on 390 ⅛-in×⅛-in grid squares.

17. The transparent ink-jet recording film according to claim 1 comprising an ink transfer measurement of less than about 31 squares transferred when subjected to 5.7 psi pressure and 86% relative humidity for seven days, wherein said ink transfer measurement is based on 390 ⅛-in×⅛-in grid squares.

18. The transparent ink jet recording film according to claim 1 comprising an ink transfer measurement of less than about 9 squares transferred when subjected to 5.7 psi pressure and 86% relative humidity for seven days, wherein said ink transfer measurement is based on 390 ⅛- in×⅛-in grid squares.

* * * * *